US008607392B1

(12) United States Patent
Jones, Jr. et al.

(10) Patent No.: US 8,607,392 B1
(45) Date of Patent: Dec. 17, 2013

(54) TEXTILE STEAMER ASSEMBLY AND METHOD

(75) Inventors: Dennis J. Jones, Jr., Signal Mountain, TN (US); Chad Anderson, Rocky Face, GA (US)

(73) Assignee: Columbia Insurance Company, Omaha, NE (US)

( * ) Notice: Subject to any disclaimer, the term of this patent is extended or adjusted under 35 U.S.C. 154(b) by 1095 days.

(21) Appl. No.: 11/539,030

(22) Filed: Oct. 5, 2006

Related U.S. Application Data

(60) Provisional application No. 60/724,018, filed on Oct. 5, 2005.

(51) Int. Cl.

| | |
|---|---|
| ***D06B 19/00*** | (2006.01) |
| ***C11D 3/00*** | (2006.01) |
| ***D06P 5/00*** | (2006.01) |
| ***D06P 1/94*** | (2006.01) |
| ***D06P 5/20*** | (2006.01) |
| ***D06P 1/00*** | (2006.01) |

(52) U.S. Cl.
USPC ..... 8/149.3; 8/115.51; 8/469; 8/475; 8/476; 8/636; 8/929

(58) Field of Classification Search
USPC ..... 8/115.51, 467, 469, 475, 476, 149.3, 8/636, 929
See application file for complete search history.

(56) References Cited

U.S. PATENT DOCUMENTS

| | | | | | |
|---|---|---|---|---|---|
| 1,585,575 | A | | 5/1926 | Husan | |
| 1,915,106 | A | | 5/1933 | Shuttleworth | |
| 2,008,230 | A | * | 7/1935 | Spooner | 68/5 D |
| 3,152,381 | A | * | 10/1964 | Priester, Jr. et al. | 156/91 |
| 3,542,506 | A | | 11/1970 | Case et al. | |
| 3,576,058 | A | | 4/1971 | Berg et al. | |
| 3,676,991 | A | | 7/1972 | Fairfield | |
| 3,683,648 | A | | 8/1972 | Fleissner | |
| 3,761,977 | A | * | 10/1973 | Rappoport | 8/149.3 |
| 3,797,073 | A | | 3/1974 | Fairfield | |
| 3,852,980 | A | | 12/1974 | Zimmer | |
| 3,913,359 | A | * | 10/1975 | Childers et al. | 68/183 |
| 3,949,577 | A | | 4/1976 | Fleissner | |
| 3,954,404 | A | | 5/1976 | Childers et al. | |
| 3,955,386 | A | | 5/1976 | Meier-Windhorst | |
| 3,969,780 | A | | 7/1976 | Henderson | |
| 3,991,481 | A | | 11/1976 | Coraor et al. | |
| 3,992,144 | A | | 11/1976 | Jackson | |
| 3,998,588 | A | | 12/1976 | Coraor et al. | |
| 4,070,877 | A | | 1/1978 | Fleissner | |
| 4,134,726 | A | | 1/1979 | Rye et al. | |
| 4,259,853 | A | | 4/1981 | Fleissner | |
| 4,286,394 | A | | 9/1981 | Gort | |
| 4,301,577 | A | | 11/1981 | Mueller et al. | |
| 4,431,429 | A | | 2/1984 | Booth | |
| 4,559,196 | A | | 12/1985 | Kobsa et al. | |
| 4,571,765 | A | | 2/1986 | Okada et al. | |
| 4,771,497 | A | | 9/1988 | Fleissner | |
| 4,930,208 | A | | 6/1990 | Winkler et al. | |
| 5,030,246 | A | | 7/1991 | Chao | |
| 5,199,126 | A | | 4/1993 | Fuller | |
| 5,201,959 | A | | 4/1993 | Fuller | |
| 5,512,062 | A | | 4/1996 | Fuller et al. | |
| 5,787,735 | A | | 8/1998 | Gunter et al. | |
| 5,931,972 | A | | 8/1999 | Foster et al. | |
| 6,139,588 | A | | 10/2000 | Foster et al. | |
| 6,397,444 | B1 | | 6/2002 | Foster et al. | |
| 6,438,934 | B1 | | 8/2002 | Foster et al. | |
| 6,836,915 | B2 | | 1/2005 | Song et al. | |

* cited by examiner

*Primary Examiner* — Harold Pyon
*Assistant Examiner* — Tanisha Diggs
(74) *Attorney, Agent, or Firm* — Ballard Spahr LLP

(57) ABSTRACT

Disclosed are processes for fixing additives in textiles that comprise applying at least one additive to the textile and substantially simultaneously directing steam onto the faces of the textile. Also disclosed are the products of the disclosed processes. Also disclosed are apparatuses for fixing additives in textiles comprising means for applying at least one additive to the textile and means for substantially simultaneously directing steam onto the faces of the textile. Also disclosed are rotating steam head assemblies for use in connection with the disclosed processes and apparatuses. This abstract is intended as a scanning tool for purposes of searching in the particular art and is not intended to be limiting of the present invention.

13 Claims, 4 Drawing Sheets

TEXTILE STEAMER ASSEMBLY AND METHOD

CROSS REFERENCE TO RELATED APPLICATIONS

This application claims the benefit of U.S. Application No. 60/724,018 filed Oct. 5, 2005, which is hereby incorporated herein by reference in its entirety.

BACKGROUND

Conventional methods and apparatuses for treating textiles with additives require the steaming of the textile to set or fix the additive to the textile after the additive has been applied to the textile. For example, the typical textile treatment method and apparatus involves the application of an additive to the pile surface of the textile, fixing the additive onto the textile pile by steaming and then subjecting the textile to various other finishing procedures prior to drying the textile. The use of a steam fixator generally entails the use of a pressure vessel and/or other high pressure equipment. Further, because steaming generally takes place within the apparatus, steam can dilute the final composition of the additive and, as it condenses into water, can dilute the actual additive composition itself. Suitable steamers have been known for many years and substantially comprise a cylindrical boiler closable by a pivotable cover. Inside the steamer is a water bath which generates steam by means of a heating device and affects the appropriate heat treatment of the material introduced. In one conventional technique, to enable the steam to better penetrate the interior of the textiles, a vacuum is generated before the heating device for the water bath is switched on. The vacuum is actively maintained as the heating device is switched on.

In treating a textile with additives, it is also known to advance a continuous textile web through a preshrinking station, moisten the textile web, apply the additive to the textile web using applicator rolls and/or additive applicators, and then fix the additive onto the textile web by passage through, for example, a chamber containing steam. This basic method generally forms the base for the other prior art textile additive treatment systems and is well known in the art as an example of the use of a steam fixator. Likewise, it is known to continuously treat a textile web material by application of an additive to the pile surface of the textile and then initiating the additive fixation onto the pile surface by steaming. Many known textile treatment systems involve such a steam fixation process and are distinguishable from each other by various additional, optional processes added onto this base conventional technique.

For example, it is known to use a high temperature, high pressure batch process for applying additive materials that incorporates a sealed pressure vessel and high-pressure steam fixation, which operates in an essentially air-free environment. In this known process, the additive fixation patent occurs at a temperature over about 125° C., creating the need for significant energy input. Likewise, it is known to use a method for fixing additive material which is carried out in a sealed chamber, namely a closed chamber incorporating compressed air and saturated steam. This method is carried out at a temperature substantially above 100° C. and under pressure. In use, this method incorporates a steam fixation step when the material emerges from the water-based additive bath which is heated substantially above 100° C. In this fixation step, the material encounters compressed air and saturated steam under pressure.

Various other methods, apparatuses and compositions for fixing additives to textiles have been developed over the years, both at high temperatures, that is 100° C. and above, and at low temperatures, that is below 100° C., at atmospheric pressure and at high pressures, that is above atmospheric pressure, and using additive compositions using dyes such as polyhydric alcohols, glycerol, and the like.

SUMMARY

Disclosed are exemplary processes for fixing an additive in a textile having a front face and an opposed back face progressively moved along a machine path. In one aspect, the processes comprise the steps of applying at least one additive to the textile; directing a first predetermined amount of steam onto at least a portion of the front face; and directing a second predetermined amount of steam onto at least a portion of the back face. In a further aspect, the directing steps are performed within less than about 15 seconds of each other.

Also disclosed are exemplary processes for fixing an additive in a carpet greige good, wherein the carpet greige good has a front face and an opposed back face, wherein the front face comprises a carpet pile having a plurality of carpet fibers extending outwardly from the front face, wherein the fibers have a length, comprising applying an additive to the plurality of fibers of the greige good; and directing a first predetermined amount of steam onto at least a portion of the front face and substantially simultaneously directing a second predetermined amount of steam onto at least a portion of the back face, thereby substantially uniformly exhausting the additive along at least about 80% of the length of the plurality of fibers.

Also disclosed are exemplary products of the disclosed processes.

Also disclosed are exemplary apparatuses for fixing an additive in a textile having a front face and an opposed back face progressively moved along a machine path comprising means for applying at least one additive to the textile; means for directing a first predetermined amount of steam onto at least a portion of the front face; and means for directing a second predetermined amount of steam onto at least a portion of the back face; wherein the means for directing a first predetermined amount of steam is positioned less than about fifteen feet along the machine path from the means for directing a second predetermined amount of steam.

Also disclosed are exemplary apparatuses for fixing an additive in a textile having a front face and an opposed back face progressively moved along a machine path comprising means for applying at least one additive to the textile; at least one rotating steam head assembly comprising (1) a steam source, and (2) a steam pipe in fluid communication with the steam source, wherein the steam pipe has a distal head adapted to direct a predetermined amount of steam to the textile, wherein the steam pipe is adapted to rotate between a first position wherein the distal head is spaced a first distance from the textile and positioned at a first angle from the front face or the back face of the textile and a second position wherein the distal head is spaced a second distance from the textile and positioned at a first angle from the front face or the back face of the textile.

Other apparatus, methods, and aspects and advantages of the invention will be discussed with reference to the Figures and to the detailed description of the preferred embodiments.

BRIEF DESCRIPTION OF THE FIGURES

The accompanying drawings, which are incorporated in and constitute a part of this specification, illustrate several embodiments and together with the description illustrate the disclosed compositions and methods.

DETAILED DESCRIPTION

Figure 1:
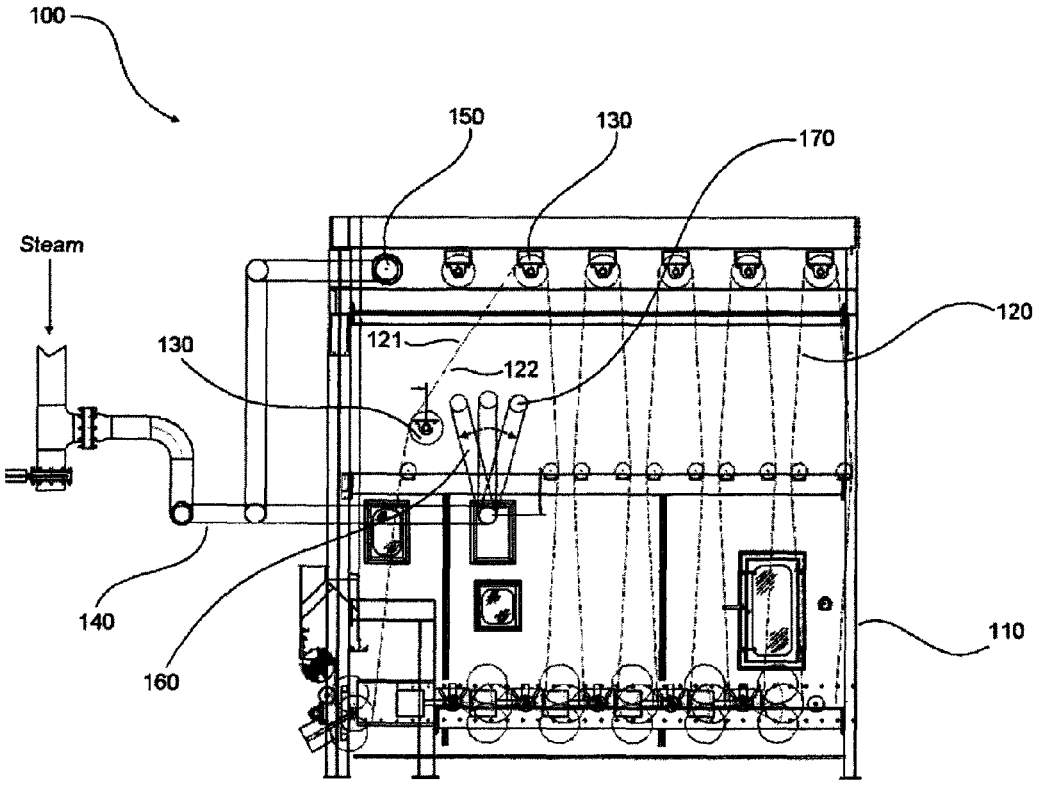
FIG. 1 shows a schematic drawing of a side view of one aspect of the disclosed textile steamer assembly suitable for performing the disclosed methods.

The present invention can be understood more readily by reference to the following detailed description, examples, drawings, and claims and their previous and following description. However, before the present apparatuses, processes, compounds, compositions, articles, devices, and/or methods are disclosed and described, it is to be understood that they are not limited to specific synthetic methods unless otherwise specified, or to particular reagents unless otherwise specified, as such can, of course, vary. It is also to be understood that the terminology used herein is for the purpose of describing particular embodiments only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used in the specification and the appended claims, the singular forms "a," "an" and "the" include plural referents unless the context clearly dictates otherwise. Thus, for example, reference to "a textile" or "an additive" includes mixtures of two or more such textiles or additives, and the like.

Ranges can be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats and that this data represents endpoints and starting points, and ranges for any combination of the data points. For example, if a particular data point "10" and a particular data point 15 are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

As used herein, the term "optional" or "optionally" means that the subsequently described event or circumstance may or may not occur, and that the description includes instances where said event or circumstance occurs and instances where it does not.

As used herein, the term "textile" or "textiles" means any structure made of raw textile materials and includes materials in both fibrous and sheet form. It is known that heat treatment has a favorable effect on various textiles, such as yarns, etc., for further processing. Textiles can also be conditioned or finished by treatment in a steam phase, if necessary with the addition of chemicals.

As used herein, the term "steam" means vaporized water and includes both superheated and desuperheated steam.

Disclosed are the components to be used to prepare the disclosed compositions as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these compounds may not be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the disclosed compositions. Thus, if there are a variety of additional steps that can be performed it is understood that each of these additional steps can be performed with any specific embodiment or combination of embodiments of the disclosed methods.

It is understood that the compositions disclosed herein have certain functions. Disclosed herein are certain structural requirements for performing the disclosed functions, and it is understood that there are a variety of structures which can perform the same function which are related to the disclosed structures, and that these structures will typically achieve the same result.

Generally, a problem in the fixation of printed textiles, such as carpets, is the prevention of a color shift, for example into the light-colored ground shade. Such a shift can occur if the textile is not uniformly heated under the effect of condensing steam in order to "fix" or "exhaust" a reactive additive, for example a dye, that has been applied to the textile. Color shift can result in at least a portion of the textile having fibers with a brightness, shade, hue, or depth of color that is less than satisfactory. Problematically, such color shift can be especially noticeable and, therefore, problematic in carpeting bearing long length face fibers.

In contrast, the disclosed processes and apparatuses can minimize or eliminate color shift derived from less-than-uniform heating resulting in less-than-uniform additive "fixation" or "exhaustion." As a result, the resultant products of the disclosed processes and apparatuses can be characterized by superior "fixation" or "exhaustion" of additives applied to a textile.

In one embodiment, the disclosed invention relates to a process for fixing an additive in a textile having a front face and an opposed back face progressively moved along a machine path comprising the steps of applying at least one additive to the textile; directing a first predetermined amount of steam onto at least a portion of the front face; and directing a second predetermined amount of steam onto at least a portion of the back face; wherein the directing steps are performed within less than about 15 seconds of each other.

In a further aspect, the disclosed invention relates to a process for fixing an additive in a carpet greige good, wherein the carpet greige good has a front face and an opposed back face, wherein the front face comprises a carpet pile having a plurality of carpet fibers extending outwardly from the front face, wherein the fibers have a length, comprising applying an additive to the plurality of fibers of the greige good; and directing a first predetermined amount of steam onto at least a portion of the front face and substantially simultaneously directing a second predetermined amount of steam onto at least a portion of the back face, thereby substantially uniformly exhausting the additive along at least about 80% of the length of the plurality of fibers.

Generally, the disclosed processes and apparatuses can be used in connection with any textile known to those of skill in the art. In particular, the textile can have a front face and an opposed back face, and the textile can be progressively moved along a machine path, for example, a path of a continuous dyeing and steaming apparatus.

In a further aspect, the disclosed processes and apparatuses can be used in connection with carpeting. For example, the textile can be broadloom carpeting, and the broadloom carpeting can be subsequently, cut into carpet tiles. In a further aspect, the textile can be a carpet greige good, and the front face can comprise a carpet pile having a plurality of carpet fibers extending outwardly from the front face of the greige good.

In one aspect, the carpet fibers can comprise any material suitable for carpet pile fibers known to those of skill in the art. In further aspects, the fibers can comprise polyamide, for example, nylon 6 or nylon 6,6; polyester; polyolefin, for example, polypropylene or polyethylene; polyacrylonitrile; wool; silk; cotton; or a copolymer thereof; or a mixture or blend thereof. In various aspects, the textile can be permeable.

In a further aspect, the fibers can have a length. For example, the length can be less than 0.5 inch, greater than about 0.5 inch, greater than about 1 inch, greater than about 1.5 inches, or greater than about 2 inches.

Generally, the disclosed processes and apparatuses can be used in connection with any additives for textiles or carpeting known to those of skill in the art. However, in one aspect, the additives comprise materials reactive with the textile fibers. That is, the additives can be "fixed" or "exhausted" by heating while in contact with the textile fibers in order to substantially permanently bind the additive to the fibers.

In a further aspect, the additive can be at least one dye, stain resistance agent, soil resistance agent, antistatic agent, or a mixture thereof. In an even further aspect, the additive comprises at least one dye.

The disclosed additives can be applied to the textile as solids or as liquids, as applicable. Further, in various aspects, the disclosed additives can be applied to the textile as an organic or aqueous solution, as an organic or aqueous suspension, as an emulsion, or as a foam.

Generally, the disclosed processes and apparatuses can be used in connection with directing steam onto the front or back face of a textile. In one aspect, the disclosed processes and apparatuses can be used in connection with directing steam onto the front face and the back face of a textile. The directing steps can be conducted, for example, at the front face and at the back face at the same time or a two distinct but similar times. In one aspect, the directing steps can be performed within less than about 10 seconds of each other, for example, within less than about 5 seconds of each other, within less than about 2 seconds of each other, or substantially simultaneously.

Generally, the steam is directed to at least a portion of the front face. In one aspect, the steam directed to the front face is concentrated at the at least a portion of the front face. This portion of the front face can, for example, comprise the area of the front face comprising about ten linear feet of the front face, measured along the machine path. For example, this portion of the front face can, for example, comprise the area of the front face comprising about five linear feet of the front face, about five linear feet, or about two linear feet, measured along the machine path.

Likewise, generally, the steam is directed to at least a portion of the back face. In one aspect, the steam directed to the back face is concentrated at the at least a portion of the back face. This portion of the back face can, for example, comprise the area of the back face comprising about ten linear feet of the back face, measured along the machine path. For example, this portion of the back face can, for example, comprise the area of the back face comprising about five linear feet of the back face, about five linear feet, or about two linear feet, measured along the machine path.

In one aspect, the at least a portion of the front face and the at least a portion of the back face at least partially overlap. That is, the area of the front face on which steam is directed and the area of the back face on which steam is directed are substantially directly opposed, and these areas comprise same length of the textile, as measured along the machine path.

In one aspect, the steam directed onto the textile penetrates into the at least a portion of the front face of the textile. In a further aspect, the steam directed onto the textile penetrates into the at least a portion of the back face of the textile. In a yet further aspect, the steam directed onto the textile penetrates into the at least a portion of both the front face and the back face of the textile.

Generally, the disclosed processes and apparatuses can direct the steam onto the textile at any suitable angle. The angle at which the steam is directed onto a face of the textile is typically the angle between the path of steam emanating from the steam head, steam vent, steam duct, or other steam source and the plane of the face of the textile.

In one aspect, steam is directed at an angle of from about 0° to about 90°, for example, from about 45° to about 90°, from about 60° to about 90°, or at about 90°, relative to the front face of the textile. Likewise, in one aspect, steam is directed at an angle of from about 0° to about 90°, for example, from about 45° to about 90°, from about 60° to about 90°, or at about 90°, relative to the front face of the textile. It is understood that the angle of directing steam can be the same or different for each face of the textile.

Generally, the disclosed processes and apparatuses can direct the steam onto the textile at any suitable pressure. It is understood that the steam pressure can be any pressure known to those of skill in the art to be suitable for steaming a textile. However, the steam pressure is typically selected such that the steam does not remove additive solution, for example, dye liquor, from the textile before the additive is fixed.

In one aspect, steam can be directed onto the textile at a pressure of less than about 20 psi, for example, at a pressure of less than about 10 psi, at a pressure of less than about 5 psi, at a pressure of less than about 2 psi, at a pressure of less than about 1 psi, at a pressure of less than about 0.5 psi, or at a pressure of less than about 0.25 psi. In a further aspect, the pressure can be from about 0.01 psi to about 0.25 psi, from about 0.01 psi to about 0.5 psi, from about 0.01 psi to about 1 psi, from about 0.01 psi to about 2 psi, from about 0.01 psi to about 5 psi, from about 0.01 psi to about 10 psi, or from about 0.01 psi to about 20 psi. In a further aspect, the pressure can be greater than about 20 psi.

In a further aspect, the disclosed processes can further comprise the step of regulating the first predetermined amount of steam relative to the second predetermined amount of steam. Any method of regulation known to those of skill in the art can be employed in connection with the disclosed processes. For example, valves, vents, or separately controlled steam sources can be used to regulate the relative amounts, or pressures, or steam.

In a further aspect from about 1% to about 99% of the total steam, based upon the combined respective first and second predetermined amounts of steam, can be directed onto the at least a portion of the front face. For example, from about 10% to about 90% of the total steam, from about 30% to about 70% of the total steam, or about 50% of the total steam, based upon the combined respective first and second predetermined amounts of steam, can be directed onto the at least a portion of the front face. Likewise, from about 1% to about 99% of the total steam, based upon the combined respective first and second predetermined amounts of steam, can be directed onto the at least a portion of the back face. For example, from about 10% to about 90% of the total steam, from about 30% to about 70% of the total steam, or about 50% of the total steam, based upon the combined respective first and second predetermined amounts of steam, can be directed onto the at least a portion of the back face.

Generally, the disclosed additives can be "fixed" or "exhausted" by heating while in contact with the textile fibers in order to substantially permanently bind the additive to the fibers. Such heating can be accomplished by directing steam onto the textile while in contact with the disclosed additives. In one aspect, by substantially uniformly directing steam onto the textile, the textile fibers are substantially uniformly heated, thereby substantially uniformly fixing or exhausting additive along at least about 90% of the length of the plurality of fibers, along at least about 95% of the length of the plurality of fibers, or along at least about 99% of the length of the plurality of fibers.

In a further aspect, each fiber is uniformly heated along the length of the fiber, whereby each fiber is substantially uniformly colored. In a yet further aspect, each fiber is uniformly heated along at least 80% of the length of the fiber, whereby each fiber is substantially uniformly colored on at least 80% of the fiber.

The textiles produced by the disclosed processes and apparatuses generally achieve superior uniformity of heating during the steaming step. As a result, the textiles produced by the disclosed processes and apparatuses generally achieve superior "fixing" or "exhausting" during such a step, thereby generally resulting in substantially uniformly colored product.

In a further embodiment, the disclosed invention relates to an apparatus for fixing an additive in a textile having a front face and an opposed back face progressively moved along a machine path. In one aspect, the apparatus comprises means for applying at least one additive to the textile; means for directing a first predetermined amount of steam onto at least a portion of the front face; and means for directing a second predetermined amount of steam onto at least a portion of the back face. In this aspect, the means for directing a first predetermined amount of steam can be positioned less than about fifteen feet along the machine path from the means for directing a second predetermined amount of steam.

The disclosed additives can be applied to the textile as solids or as liquids, as applicable. Further, in various aspects, the disclosed additives can be applied to the textile as an organic or aqueous solution, as an organic or aqueous suspension, as an emulsion, or as a foam. Accordingly, the means for applying can be any means know to those of skill in the art for applying solids, liquids, solutions, suspensions, emulsions, or foams. In one aspect, the means for applying can be, for example, a contact applicator, a non-contact applicator, a foam applicator, a spray jet, or a solution vat.

Generally, it is contemplated that the means for directing can be any means know to those of skill in the art for supplying steam to a textile. In one aspect, the means for directing can be, for example and not meant to be limiting, a front face steam head positioned adjacent to the front face and a back face steam head positioned adjacent to the back face. Optionally, the means for directing can be a rotating steam head assembly as disclosed herein. In this exemplary aspect, the rotating steam head assembly can comprise a steam source and a steam pipe in fluid communication with the steam source. In one aspect, the steam pipe has a distal head that is configured to direct a predetermined amount of steam to the textile. In a further aspect, the steam pipe is configured to rotate between a first position, in which the distal head is spaced a first distance from the textile and positioned at a first angle from the front face or the back face of the textile, and a second position, in which the distal head is spaced a second distance from the textile and positioned at a first angle from the front face or the back face of the textile.

In one exemplary aspect, one rotating steam head assembly is used in the apparatus and directs steam to at least a portion of the front face. In a further exemplary aspect, one rotating steam head assembly is used in the apparatus and directs steam to at least a portion of the back face. In a yet further aspect, one rotating steam head assembly is used adjacent to the front face of the textile in the apparatus and directs a first predetermined amount of steam to at least a portion of the front face and one rotating steam head assembly is used adjacent to the back face of the textile in the apparatus and directs a second predetermined amount of steam to at least a portion of the back face.

In the apparatuses and processes described herein, it is contemplated that, in one exemplary aspect, the steam pipe is operatively attached to the steam source and is configured to rotate. This rotation can, in one aspect, position the distal head of the steam pipe at a position closer to or farther from the textile face, as desired. For example, the first distance can be greater than the second distance. Further, this rotation can, in a further aspect, position the distal head of the steam pipe to direct steam at an angle of from about 0° to about 90°, relative to the face of the textile, as desired. For example, the angle can be from about 45° to about 90°, from about 60° to about 90°, or about 90°.

In a further aspect, the disclosed invention can relate to a textile steam assembly comprising the disclosed rotating steam head assemblies. In a further aspect, the disclosed apparatuses, such as, for example and without limitation, the rotating steam head assemblies, can further comprise a means for regulating the first predetermined amount of steam relative to the second predetermined amount of steam.

In a further contemplated aspect, the means for directing can be a steam head or a rotating steam head assembly and can be positioned adjacent a face of the textile. In particular, the means for directing can be positioned less than about 48 inches from the respective face of the textile, for example, less than about 24 inches, less than about 18 inches, less than about 12 inches, or less than about 6 inches from the respective face. In a further aspect, the means for directing can be positioned greater than about 48 inches from a face of the textile.

In one aspect, the respective front and back face steam heads are spaced an equal distance from the respective front and back faces. Optionally, it is also contemplated that the respective front and back face steam heads can be spaced an unequal distance from the respective front and back faces.

It is understood that the means for directing steam onto the front face of a textile can be spaced apart from the means of directing steam onto the back face of a textile, along the machine path. For example, the means for directing a first predetermined amount of steam can be positioned less than about ten feet along the machine path from the means for directing a second predetermined amount of steam. In further examples, the means for directing a first predetermined amount of steam can be positioned less than about six feet, less than about four feet, less than about two feet, less than about one foot, or less than about 6 inches along the machine path from the means for directing a second predetermined amount of steam, or in substantial opposition to the means for directing a second predetermined amount of steam.

EXAMPLES

Referring now to FIG. 1, shown is a side view of a textile steamer assembly 100 according to one aspect of the disclosed invention. Textile 120 can have a front face 121 and a back face 122 and can pass over roller assemblies 130 and through steamer housing 110. Steam can enter steam housing 110 via steam source 140. In this example, front face 121 means for directing steam is a steam head 150. That is, steam can be directed to front face 121 of textile 120 via steam head 150. In this example, back face 122 means for directing steam is a rotating steam head assembly including a steam pipe 160 and a distal head 170. That is, steam can be directed to back face 122 of textile 120 via steam pipe 160 and distal head 170.

The rotating steam head assembly is shown in three alternate rotated positions, thereby providing distal head 170 at three different distances from the back face 122 of textile 120 and thereby directing steam onto textile 120 at three different angles.

Figure 2:
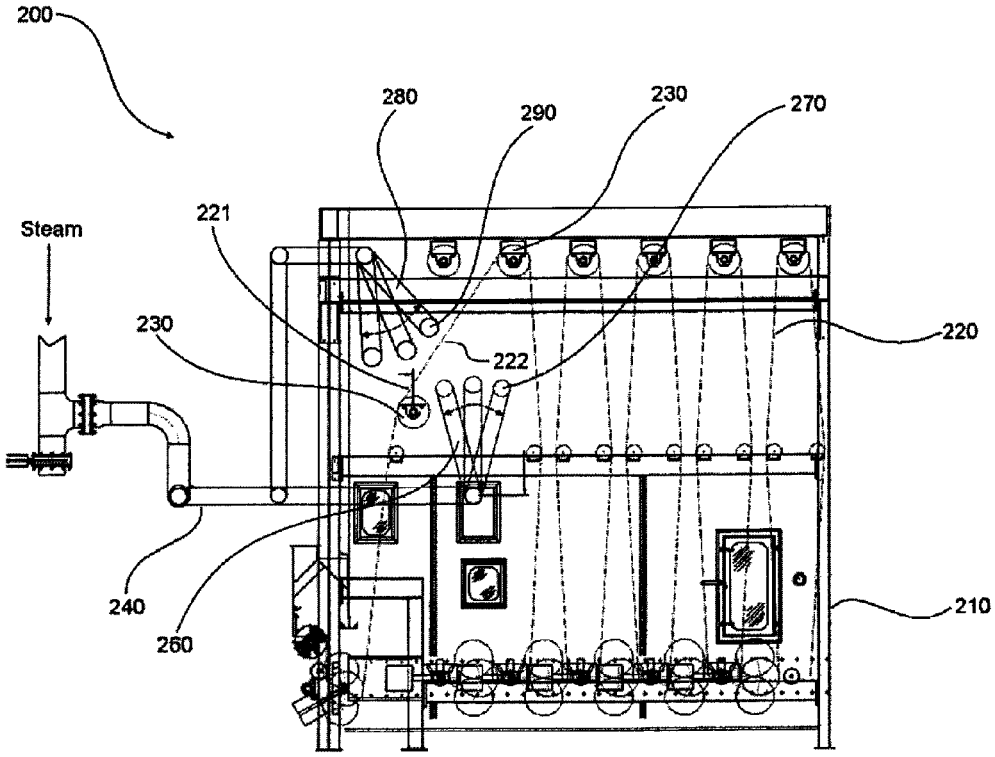
FIG. 2 shows a schematic drawing of a side view of a further aspect of the disclosed textile steamer assembly suitable for performing the disclosed methods.

Referring now to FIG. 2, a schematic elevation view of an exemplary textile steamer assembly 200 according to one aspect of the disclosed invention is illustrated. The textile 220 can have a front face 221 and a back face 222 and is configured to pass over roller assemblies 230 and through steamer housing 210. Steam can enter steam housing 210 via steam source 240. In this example, means for directing steam onto the back face 222 of the textile is a rotating steam head assembly including a steam pipe 260 and a distal head 270. The rotating steam head assembly is shown in three alternate rotated positions, thereby providing distal head 270 at three different distances from back face 222 of textile 220 and thereby directing steam onto textile 220 at three different angles. Similarly, means for directing steam onto the front face 221 is a rotating steam head assembly that includes a steam pipe 280 and a distal head 290. In this aspect, the rotating steam head assembly is shown in three alternate rotated positions, which allows for the distal head 290 to be positioned at three different distances from front face 221 of textile 220 and which allows for the steam exiting the distal head 290 to be directed onto textile 220 at three different angles.

Figure 3:
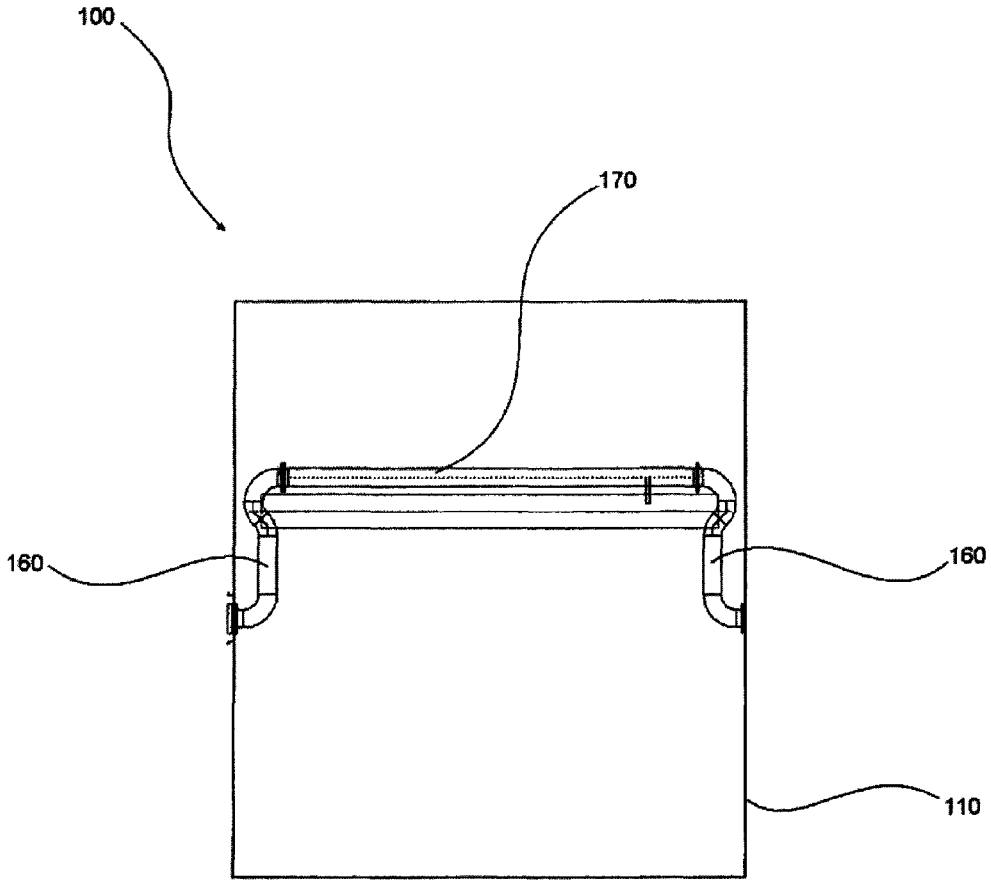
FIG. 3 shows a schematic drawing of an end view of one aspect of the disclosed textile steamer assembly suitable for performing the disclosed methods.
Figure 4:
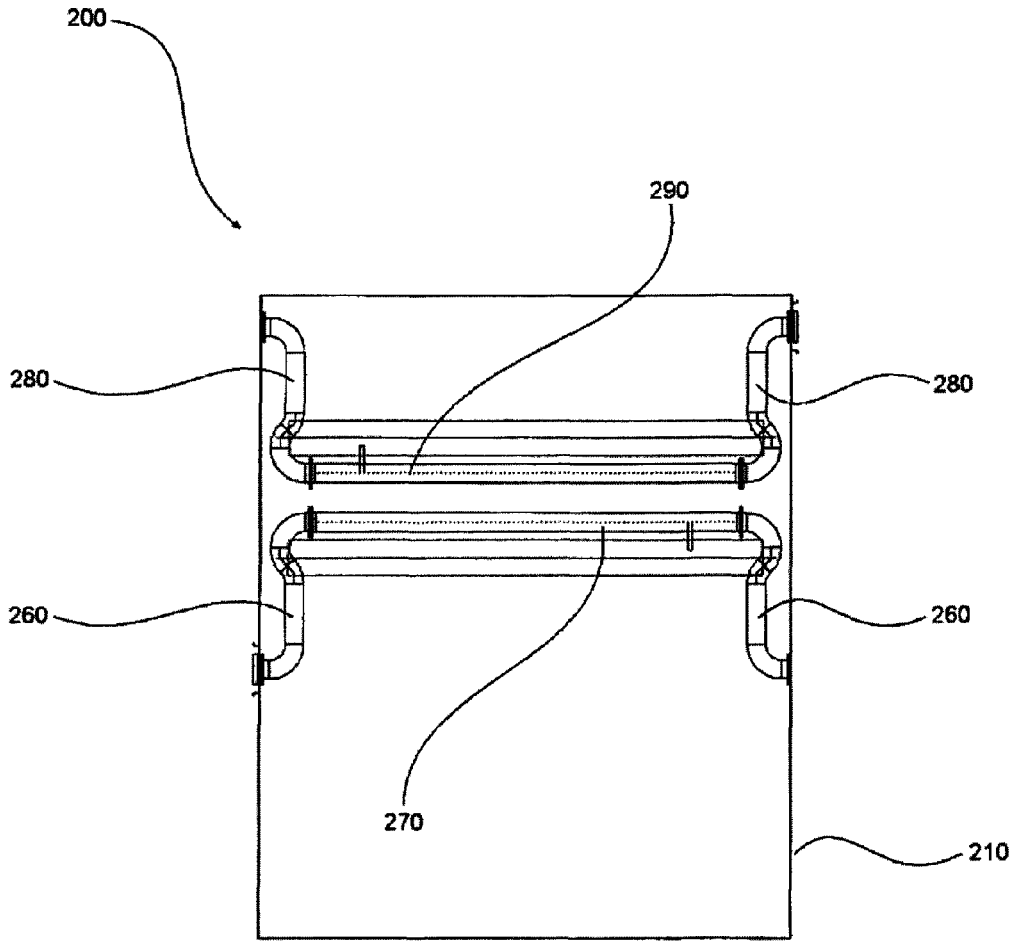
FIG. 4 shows a schematic drawing of an end view of a further aspect of the disclosed textile steamer assembly suitable for performing the disclosed methods.

Referring now to FIG. 3, a schematic end elevational view of a textile steamer assembly 100 according to one aspect of the disclosed invention is shown. In this example, means for directing steam onto the back face of the textile is a rotating steam head assembly including a steam pipe 160 and a distal head 170 that are configured for directing steam onto the back face of the textile. Similarly, and referring now to FIG. 4, the means for directing steam comprises a rotating steam head assembly that comprises a steam pipe 260 and a distal head 270. In this example, the front face means for directing steam is a rotating steam head assembly including a steam pipe 280 and a distal head 290 that are configured to direct steam to the front face of a textile.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

What is claimed is:

1. A process for fixing an additive in a textile progressively moved along a machine path comprising the steps of:

a. providing the textile, wherein the textile has a front face and an opposed back face, wherein the front face of the textile comprises a plurality of fibers extending outwardly from the front face, and wherein the fibers have an elongate length;

b. applying at least one additive to the textile;

c. uniformly exhausting the at least one additive along the elongate length of each fiber extending outwardly from the front face by:

directing a first amount of steam onto at least a portion of the front face, wherein directing a first amount of steam comprises directing steam from a first steam pipe rotatable between a first position, in which a first distal head of the steam pipe is spaced a first distance from the textile and positioned at a first angle relative to the front face of the textile, and a second position, in which the first distal head is spaced a second distance from the textile and positioned at a second angle relative to the front face of the textile and simultaneously directing a second amount of steam onto at least a portion of the back face.

2. The process of claim 1, wherein the additive comprises at least one dye.

3. The process of claim 1, wherein the at least a portion of the front face and the at least a portion of the back face at least partially overlap.

4. The process of claim 1, wherein the textile is a carpet greige good and the front face comprises a carpet pile.

5. The process of claim 1, further comprising the step of regulating the first amount of steam relative to the second amount of steam.

6. The process for fixing an additive in a carpet greige good, comprising:

a. providing the carpet greige good having a front face and an opposed back face, wherein the front face comprises a carpet pile having a plurality of carpet fibers extending outwardly from the front face, and wherein the fibers extending outwardly from the front face have an elongate length;

b. applying an additive to the plurality of carpet fibers of the greige good; and c. uniformly exhausting the additive along the elongate length of each of the plurality of carpet fibers by:

directing a first amount of steam onto at least a portion of the front face of the greige good and simultaneously direct a second amount of steam onto at least a portion of the back face of the greige good.

7. The process of claim 6, further comprising the step of regulating the first amount of steam relative to the second amount of steam.

8. The process of claim 6, wherein the additive comprises at least one dye.

9. The process of claim 6, wherein the length is greater than about 0.5 inch.

10. A process for fixing an additive in a carpet greige good, comprising;

a. providing the carpet greige food having a front face and an opposed back face, wherein the front face comprises a carpet pile having a plurality of carpet fibers extending outwardly from the front face, and wherein the fibers extending outwardly from the front face have an elongate length greater than about 0.5 inch;

b. applying an additive to the plurality of carpet fibers of the greige good; and c. uniformly exhausting the additive along the elongate length of each of the plurality of carpet fibers by:

directing a first amount of steam onto at least a portion of the front face of the greige good and simultaneously directing a second amount of steam onto at least a portion of the back face of the greige good.

11. The process of claim 10, further comprising the step of regulating the first amount of steam relative to the second amount of steam.

12. The process of claim 10, wherein the additive comprises at least one dye.

13. The process of claim 10, wherein directing a first amount of steam onto at least a portion of the front face comprises directing steam from a first steam pipe rotatable between a first position, in which a first distal head of the first steam pipe is spaced a first distance from the textile and positioned at a first angle relative to the front face of the textile, and a second position, in which the first distal head is spaced a second distance from the textile and positioned at a second angle relative to the front face of the textile.

* * * * *